US009484689B2

(12) United States Patent
Wu et al.

(10) Patent No.: US 9,484,689 B2
(45) Date of Patent: Nov. 1, 2016

(54) WIRE SPACER FOR DIFFERENT TYPES OF CABLE WIRES

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/700,161

(22) Filed: Apr. 30, 2015

(65) Prior Publication Data

US 2015/0318647 A1 Nov. 5, 2015

(30) Foreign Application Priority Data

Apr. 30, 2014 (CN) ..... 2014 1 0178582
Aug. 7, 2014 (CN) ..... 2014 1 0385895
Aug. 7, 2014 (CN) ..... 2014 1 0385970

(51) Int. Cl.

| | |
|---|---|
| ***H01R 43/00*** | (2006.01) |
| ***H01R 24/60*** | (2011.01) |
| ***H01R 43/28*** | (2006.01) |
| *H01R 107/00* | (2006.01) |
| *H01R 12/53* | (2011.01) |
| *H01R 24/30* | (2011.01) |

(52) U.S. Cl.

CPC ..... *H01R 24/60* (2013.01); *H01R 43/28* (2013.01); *H01R 12/53* (2013.01); *H01R 24/30* (2013.01); *H01R 2107/00* (2013.01); *Y10T 29/49176* (2015.01)

(58) Field of Classification Search

CPC ..... H01R 12/772; H01R 12/775
USPC ..... 439/492, 494, 497, 499, 579; 29/857, 29/860

See application file for complete search history.

(56) References Cited

U.S. PATENT DOCUMENTS

| | | | | | |
|---|---|---|---|---|---|
| 4,767,357 | A * | 8/1988 | Hasircoglu | H01R 23/667 | 439/499 |
| 4,817,281 | A * | 4/1989 | Sugawara | H01R 12/592 | 174/117 F |
| 5,049,090 | A * | 9/1991 | Johnson | H01R 12/62 | 439/329 |
| 5,267,874 | A * | 12/1993 | Koegel | H01R 13/6592 | 439/497 |
| 5,272,807 | A * | 12/1993 | Henschen | B23K 3/0475 | 29/863 |
| 5,328,386 | A * | 7/1994 | Frantz | H01R 13/58 | 439/465 |
| 5,415,567 | A * | 5/1995 | Fusselman | H01R 9/03 | 439/394 |
| 6,705,893 | B1 * | 3/2004 | Ko | H01R 12/714 | 439/497 |
| 6,802,744 | B2 * | 10/2004 | Chiang | H01R 4/023 | 439/701 |
| 6,832,931 | B1 * | 12/2004 | Wu | H01R 12/592 | 439/499 |

(Continued)

*Primary Examiner* — Neil Abrams
(74) *Attorney, Agent, or Firm* — Wei Te Chung; Ming Chieh Chang

(57) ABSTRACT

A method associated with the related structures to prepare cable wires of a cable connector, comprising the steps of: extending a first type and a second type of cable wires through a wire spacer having a notch; securing the first and second types of wires to the spacer; bending the extended cable wires of the first type in the spacer notch; operating the extended cable wires of the second type; returning the extended cable wires of the first type; and operating the extended cable wires of both the first type and the second type. The second type may be coaxial cables and the operating steps on these coaxial cables may include steps of removing outer jackets and braidings.

9 Claims, 10 Drawing Sheets

(56) References Cited

U.S. PATENT DOCUMENTS 7,147,512 B2 * 12/2006 Wu ..... H01R 12/721 439/607.05
7,267,575 B1 * 9/2007 Hwang ..... H01R 9/034 439/497
7,275,953 B2 * 10/2007 Brown ..... H01R 43/0263 439/449
7,311,552 B1 * 12/2007 Ko ..... H01R 4/023 439/404
7,497,724 B1 * 3/2009 Fong ..... H01R 4/023 439/497
7,507,127 B2 * 3/2009 Nagata ..... H01R 13/5808 439/878
7,540,785 B1 * 6/2009 Zhao ..... H01R 12/592 439/660
7,549,895 B2 * 6/2009 Kondo ..... H01R 4/027 439/579
7,758,374 B2 * 7/2010 Yu ..... H01R 4/027 439/493
7,794,271 B2 * 9/2010 Wu ..... H01R 12/598 439/497
7,824,221 B2 * 11/2010 Miyoshi ..... H01R 4/023 439/352
7,896,689 B1 * 3/2011 Su ..... H01R 9/032 439/497
8,100,729 B2 * 1/2012 Chen ..... H01R 9/03 439/719
8,133,071 B2 3/2012 Huang et al.
8,858,254 B2 * 10/2014 Ikari ..... H01R 12/592 439/492
9,077,101 B2 * 7/2015 Wu ..... H01R 12/53
9,172,149 B2 * 10/2015 Xing ..... H01R 9/035
9,318,853 B2 * 4/2016 Little ..... H01R 13/6658
9,437,964 B2 * 9/2016 Hwang ..... H01R 13/5812
2015/0044886 A1 2/2015 Little et al.
2015/0072562 A1 3/2015 Little et al.

* cited by examiner

WIRE SPACER FOR DIFFERENT TYPES OF CABLE WIRES

BACKGROUND OF THE INVENTION

1. Field of the Invention

The present invention relates generally to an improved wire spacer or organizer in a cable connector for facilitating preparation of cable wires for subsequent mounting to an internal printed circuit board (PCB) and especially to a method of preparing the cable wires.

2. Description of Related Arts

U.S. Pat. No. 8,133,071, issued on Mar. 13, 2012, shows a cable including two different types of wires connected to pads and grounding portion of an internal flexible circuit. The two types of wires differ in that different number of operations are required to prepare the connection ends. To expose a center conductor, a first type of unshielded wire needs a single operation to remove only its outer dielectric, while a second type of shielded wire, e.g., a coaxial wire, needs three operations to remove its outer jacket, braiding, and dielectric. With proximity of the wires decreasing and length of the connection ends reducing, it will become difficult to prepare the wire needing more operations without adversely affecting the wire needing less operations.

Wire spacers or organizers are known to provide efficiency and accuracy in handling and preparing wire ends. For instance, a spacer may be accurately secured to the wires prior to operating the wire ends. However, when used together with an internal PCB, e.g., in the instance as seen in FIGS. 26 of US 2015/0044886, published on Feb. 12, 2015, where the wires secured to the spacer extend only a short distance from a front face of spacer, limited mobility of the secured wires inhibits severing operations of the shielded wires in the presence of the unshielded wires.

An improved wire spacer in a cable connector is desired.

SUMMARY OF THE INVENTION

An object of the present invention is to provide an improved wire spacer in a cable connector for facilitating preparation of cable wires including a first type and a second type.

To achieve the above-mentioned object, a method of preparing cable wires of a cable connector comprises the steps of: extending a first type and a second type of cable wires through a wire spacer having a notch; securing the first and second types of wires to the spacer; bending the extended cable wires of the first type in the spacer notch; operating the extended cable wires of the second type; returning the extended cable wires of the first type; and operating the extended cable wires of both the first type and the second type.

DETAILED DESCRIPTION OF THE PREFERRED EMBODIMENT

Figure 1:
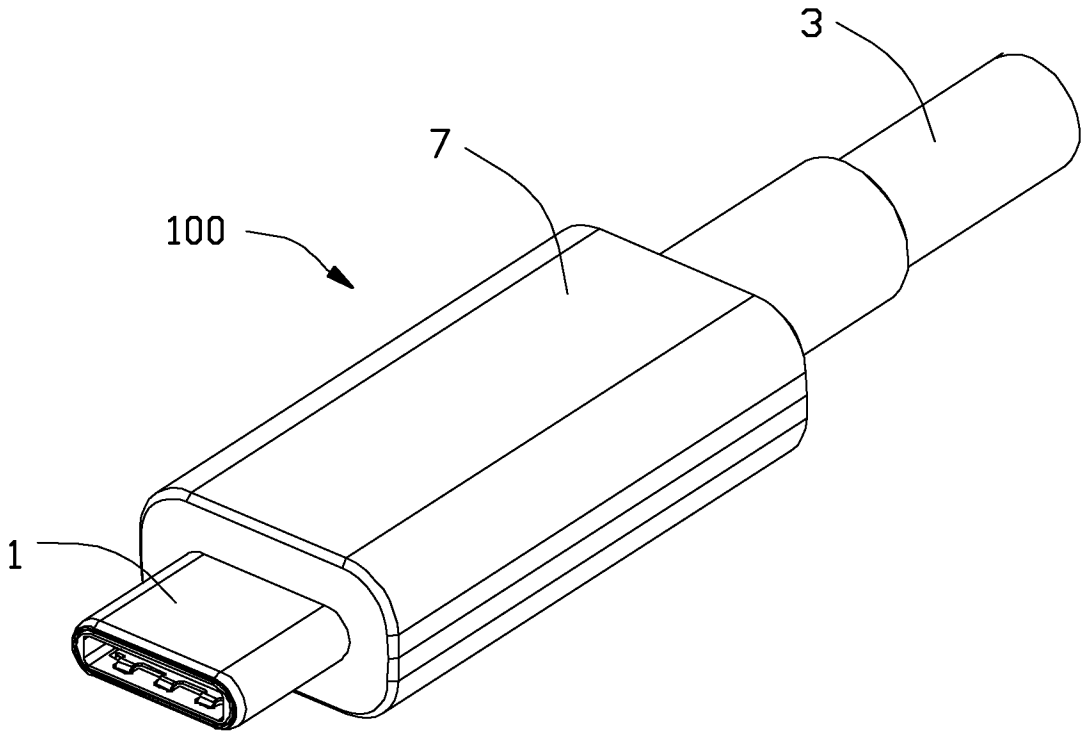
FIG. 1 is a perspective view of a cable connector in accordance with the present invention.
Figure 2:
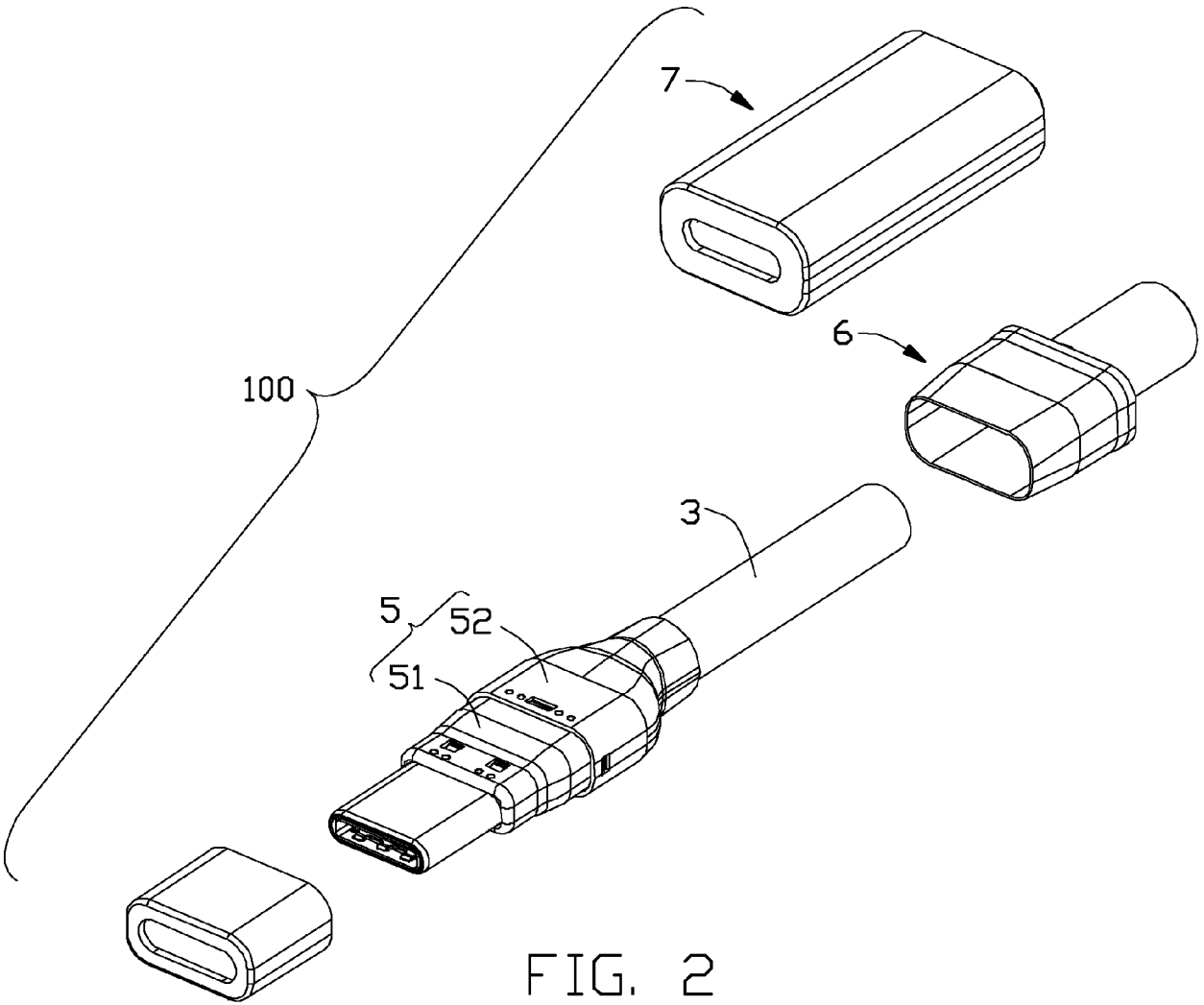
FIG. 2 is a partially exploded view of the cable connector in FIG. 1.
Figure 3:
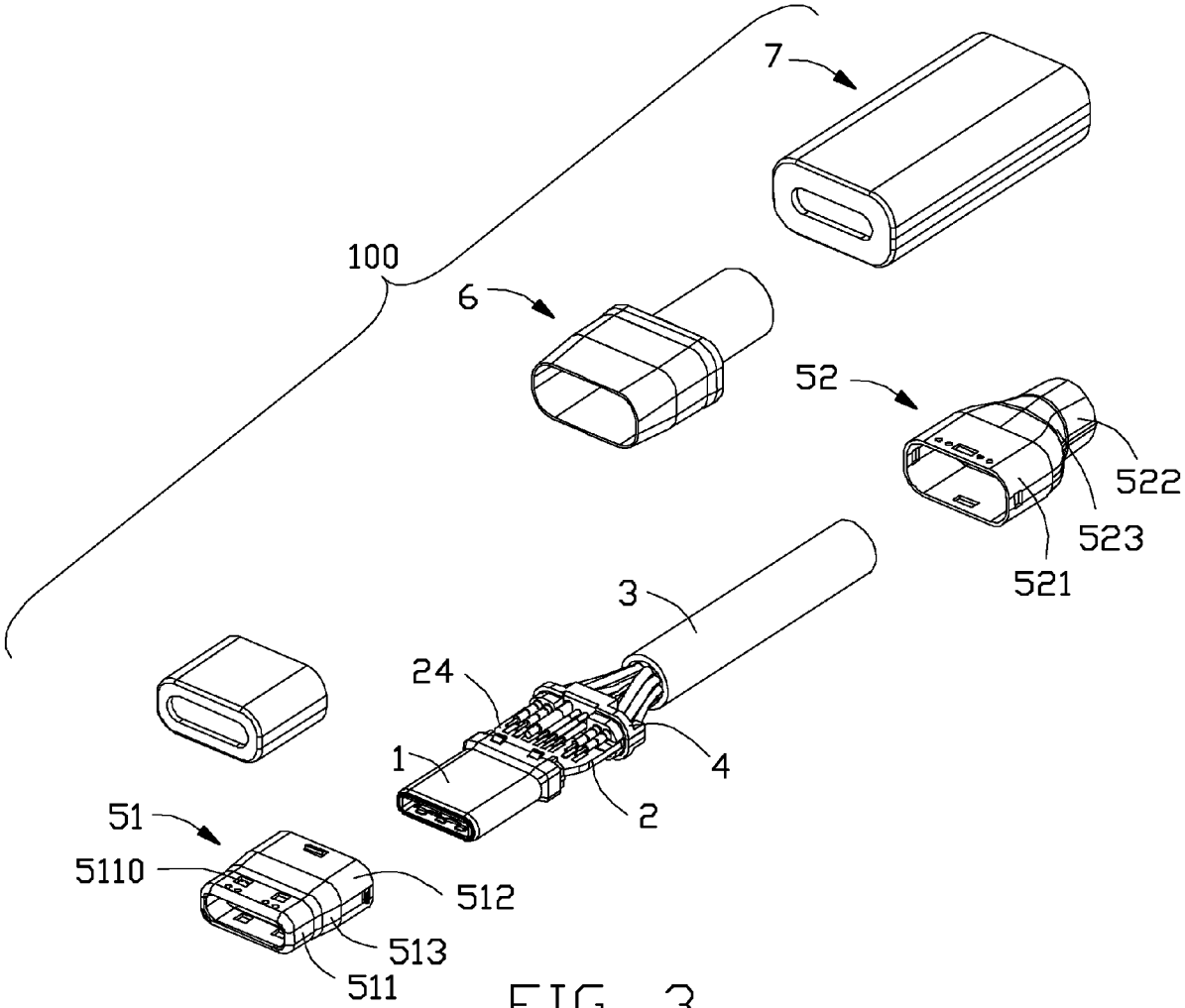
FIG. 3 is a further partially exploded view of the plug connector assembly as shown in FIG. 3.

Referring to FIGS. 1 to 3, a cable connector, e.g., a plug connector assembly 100, in accordance with the present invention for mating with a mating connector (not shown) comprises a mating member 1, an internal printed circuit board (PCB) 2 disposed behind and electrically connecting with the mating member 1, a cable 3 comprising a plurality of wires, namely a first type of wires 32 and a second type of wires 31, electrically connected with the PCB 2, a spacer or wire organizer 4 for positioning the wires 31 and 32, a first shell 51 having a closed circumference, a second shell 52 also having a closed circumference, a strain relief 6, an inner over-mold on the first shell 51, and an outer over-mold 7. The plug connector assembly can be mated with the mating connector in two orientations.

Figure 7:
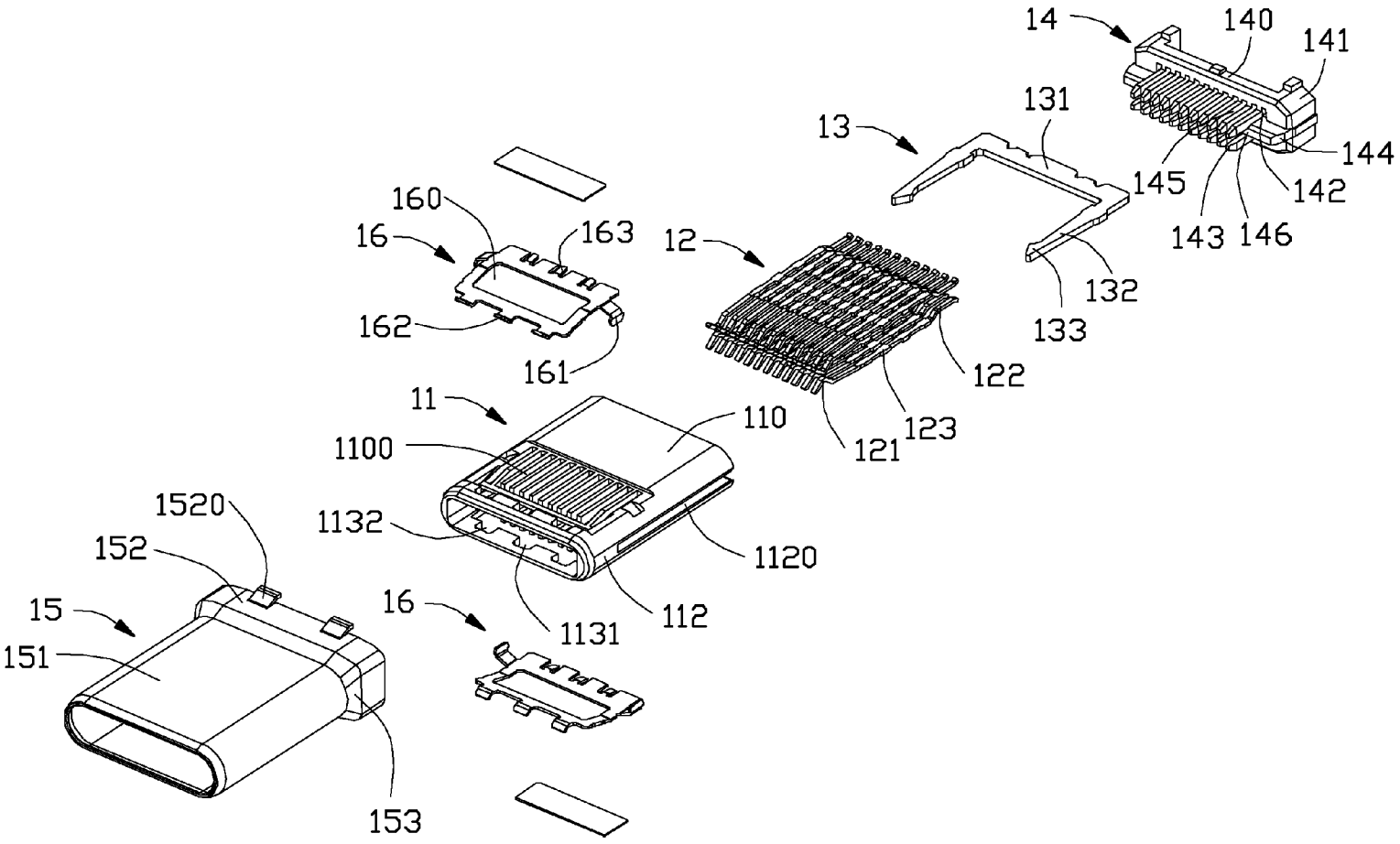
FIG. 7 is an exploded view of a mating member of the cable connector.
Figure 8:
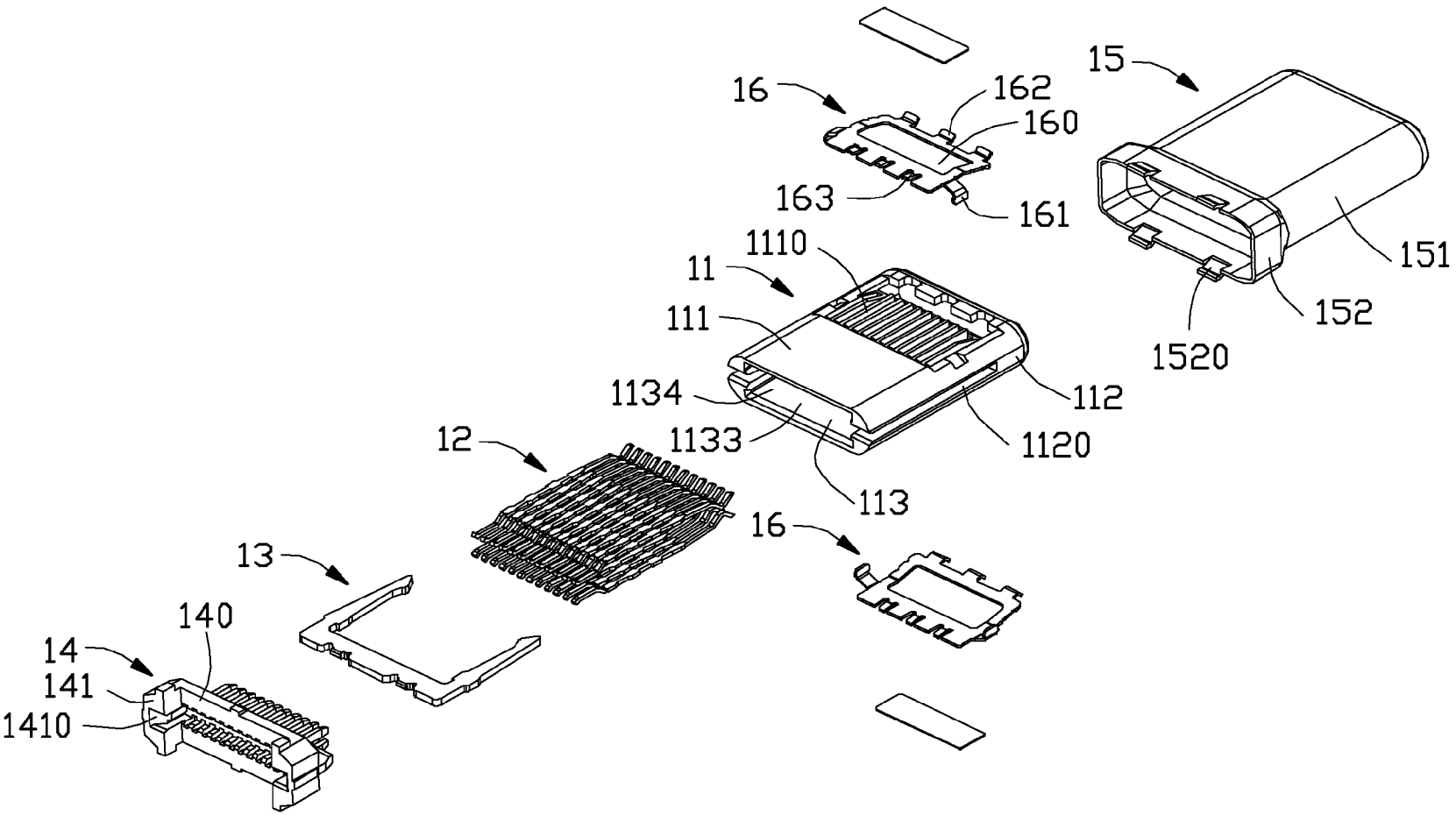
FIG. 8 is a view similar to FIG. 7 but from a different perspective.

Referring to FIGS. 7 and 8, the mating member 1 comprises an insulative housing 11, a plurality of first contacts 12 arranged in two rows and spaced apart from each other in a vertical direction, a latch 13 disposed between the two rows of contacts 12 for latching with the mating connector, an insulative member 14 disposed behind the insulative housing 11, a third shell 15 covering the insulative housing 11 and the insulative member 14, and a pair of grounding members 16 disposed on the insulative housing 11.

The insulative housing 11 comprises a top wall 110, a bottom wall 111 spaced apart from and parallel with the top wall, a pair of side walls 112 connecting the top wall 110 and the bottom wall 111, a receiving room 113 surround by the top, bottom, and side walls, and an internal wall 114 dividing the receiving room 113 into a front portion 1132 having a front opening 1131, and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113.

Each of the contacts 12 comprises a front mating portion 121 extending forwardly into the front portion 1132 of the receiving room 113, a rear mating portion 122 extending rearwardly, and an intermediate mounting portion 123 secured to the insulative housing 11. The front mating portion 121 is to be mated with the mating connector and the second mating portion 122 is to be mated with the PCB 2. The front mating portions 121 of the two row of contacts 12 are arranged face to face along the vertical direction.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction. The latch 13 is mounted into the insulative housing 11 through the rear opening 1133 of the rear portion 1134 of the receiving room 113. The base portion 131 abuts forwardly against the internal wall and the latch beams 132 are received into the side recesses 1120, respectively. At least a portion of each of the latch portions 133 projects into the front portion 1132 of the receiving room 113.

The insulative member 14 cooperates with the insulative housing 11 to fix the latch 13. The insulative member 14 comprises an insulative base portion 140, a pair of extending portions 141 extending rearwardly from two opposite ends, two rows of through holes 142 spaced apart in the vertical direction and extending through the insulative base portion 140 along a front to rear direction, two rows of posts 143 spaced apart in the vertical direction and extending forwardly, and a projected portion 144 extending forwardly between the two rows of posts 143. A channel 145 is formed between every two adjacent posts 143 of each row and is in communication with a corresponding one of the through holes 142. Each of the extending portions 141 defines a mounting slot 1410 extending along a rear to front direction. The posts 143 extend forwardly beyond the projected portion 144. A receiving slot 146 is formed between the two rows of posts 143. The insulative base portion 140 is thicker than the insulative housing 11. The insulative member 14 is mounted to the insulative housing 11 along a rear to front direction. The base portion 131 of the latch 13 is received into the receiving slot 146 of the insulative member 14, and the projected portion 144 is pressed against a rear side of the base portion 131. The rear mating portions 122 of the contacts 12 extend through the insulative member 140 through the channels 145, respectively.

The third shell 15 has a closed circumference that has a good seal performance, a good anti-EMI performance, etc. The closed circumference of the third shell 15 could be manufactured by drawing a metal piece, bending a metal piece, die casting, etc. The third shell 15 comprises a third front end 151 for being inserted into the mating connector, a third rear end 152 for being mated with the first shell 51, and a third transition portion 153 for connecting to the third front end 151 and the third rear end 152. A diametrical dimension of the third front end 151 is smaller than a diametrical dimension of the third rear end 152. The third rear end 152 comprises a pair of latch tabs 1520 projecting outwardly.

One of the grounding members 16 is received into the top recess 1110, and the other one is received into the bottom recess 1110. Each of the grounding members 16 comprises a flat body portion 160, a pair of mounting portions 161 extending from two opposite ends of the flat body portion 160 and toward the insulative housing 11 for being attached to the insulative housing 11, a plurality of front grounding tabs 162 extending forwardly from a front side of the flat body portion 160 and entering into the front portion 1132 of the receiving room 113, and a plurality of rear grounding tabs 163 extending rearwardly from a rear side of the flat body portion 160. The front grounding tabs 162 are used for mating with the mating connector. The rear grounding tabs 163 are used for mating with the third shell 15. The front grounding tabs 162 of the pair grounding members 16 are disposed face to face along the vertical direction. A distance along the vertical direction between the front grounding tabs 162 of the pair of grounding members 16 is greater than a distance along the vertical direction of the front mating portions 121 of the two rows of contacts 12.

Figure 4:
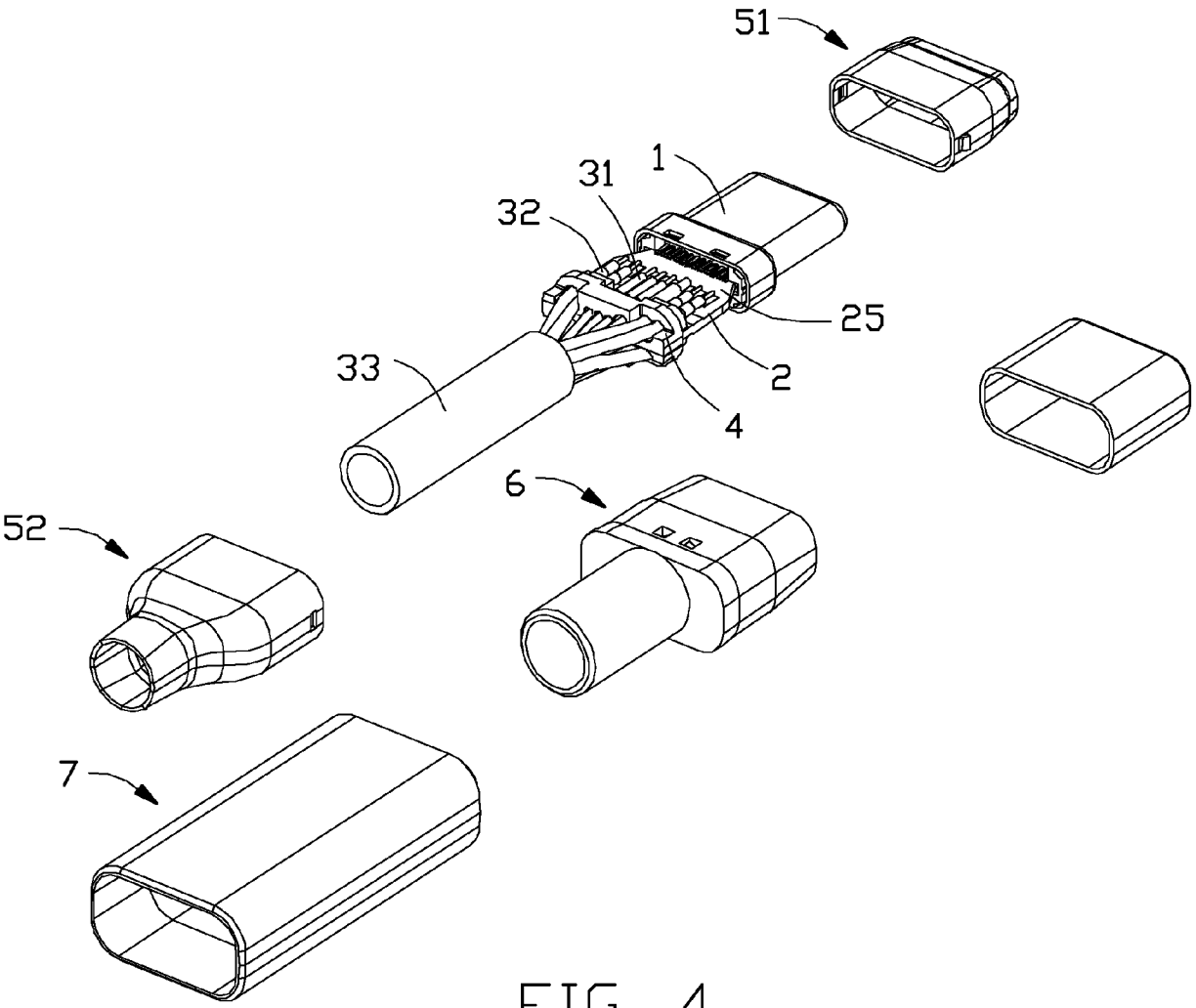
FIG. 4 is a view similar to FIG. 3 but from a different perspective.
Figure 5:
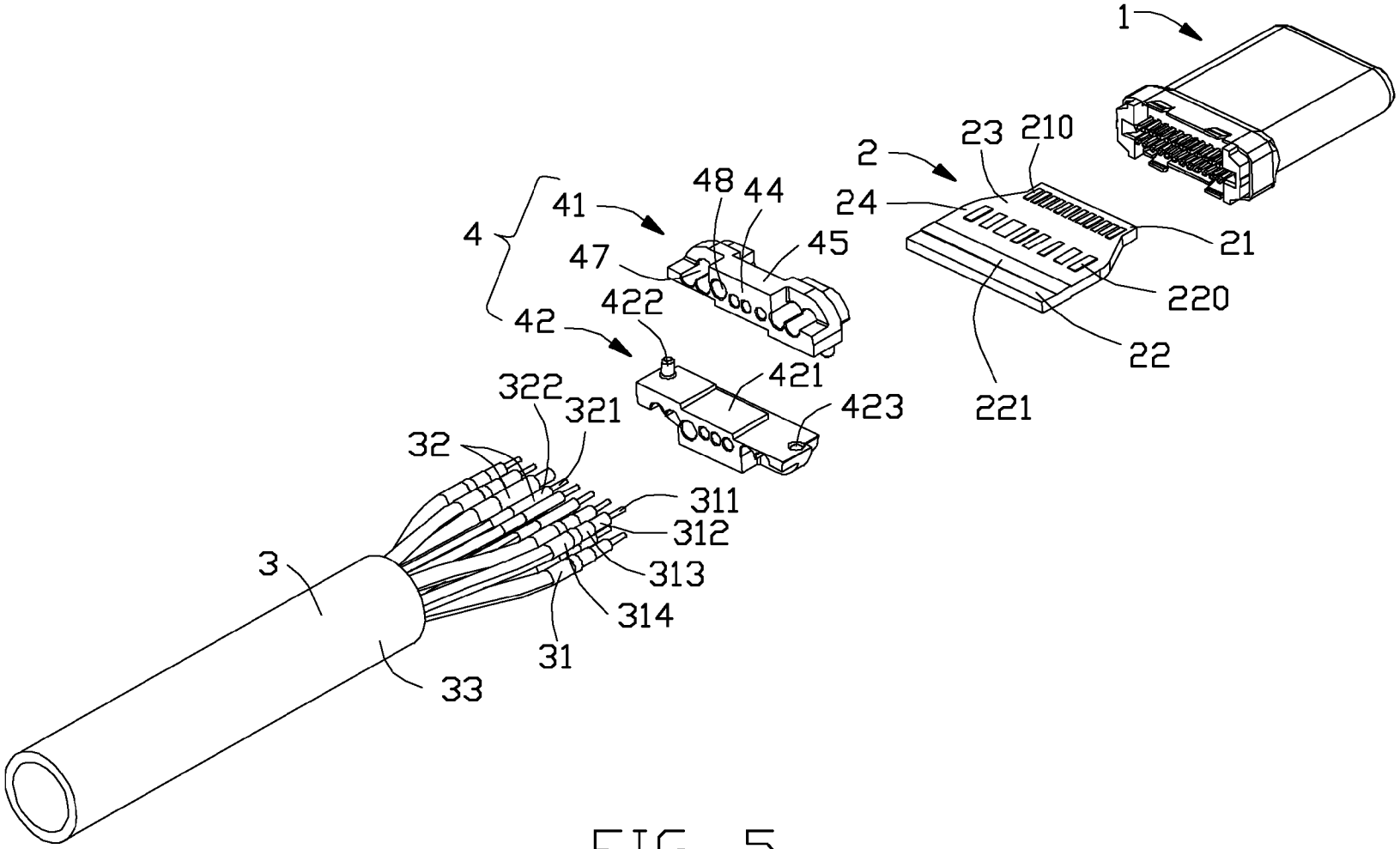
FIG. 5 is an exploded view further showing particularly a cable, a spacer, and an internal circuit board of the cable connector of FIG. 4.
Figure 6:
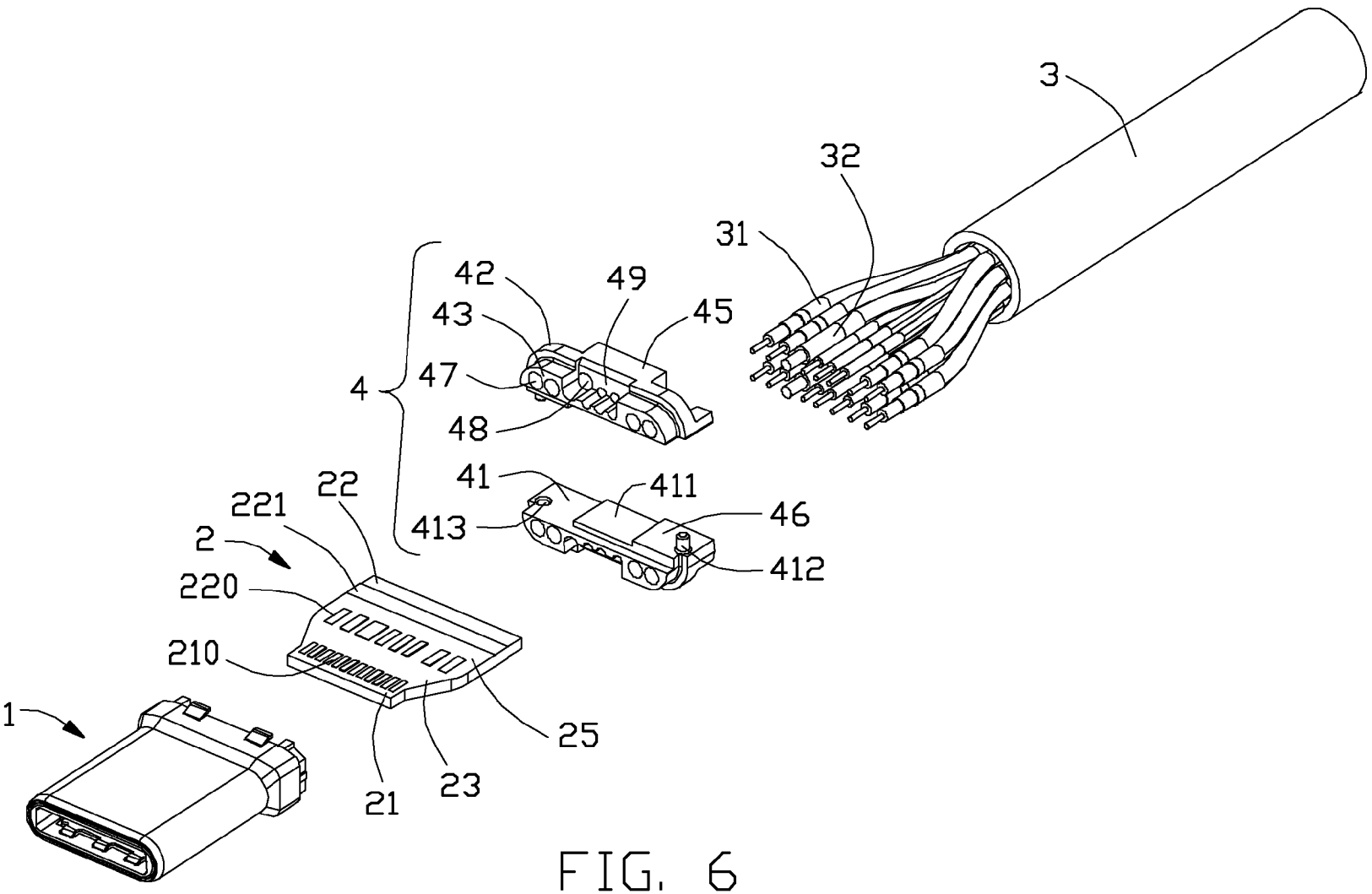
FIG. 6 is a view similar to FIG. 5 but from a different perspective.

Referring to FIGS. 4-6, the PCB 2 is disposed between the mating member 1 and the cable 3. The cable 3 is electrically connected with the contacts 12 by the PCB 2. The PCB 2 comprises a front portion 21, a rear portion 22, and a middle portion 23 connecting the front portion 21 and a rear portion 22. The front portion is smaller than the rear portion 22 along a transverse direction. The front portion 21 of the PCB 2 is disposed between the rear mating portions 122 of the two rows of contacts 12. The PCB 2 comprises a plurality of front conductive pads 210 disposed on opposite side faces of the front portion 21 for electrically connecting with the rear mating portions 122 of the contacts 12, and a plurality of rear conductive pads 220 disposed on opposite side faces of the rear portion 22 for electrically connecting with the wires 31 and 32 of the cable 3. The PCB 2 is mounted to the insulative member 14 by the front portion 21 along the mounting slots 1410.

Referring particularly to FIG. 5, the cable 3 has a sheath 33 that contains multiple wires, e.g., two types of wires. Each cable wire 32 of a first type comprises a center conductor 321 and an outer jacket or dielectric 322 while each cable wire 31 of a second type comprises a center conductor 311, an inner dielectric 312, a braiding 313, and an outer jacket 314. Prior to connecting with the PCB 2, all layers of the wires other than possibly the center conductors need be removed. In this embodiment, the first type of wires 32 need to remove the dielectrics 322, e.g., in one operation, while the second type of wires 31 need to remove sequentially the outer jacket 314, braiding 313, and inner dielectric 312, e.g., in three operations.

Figure 9:
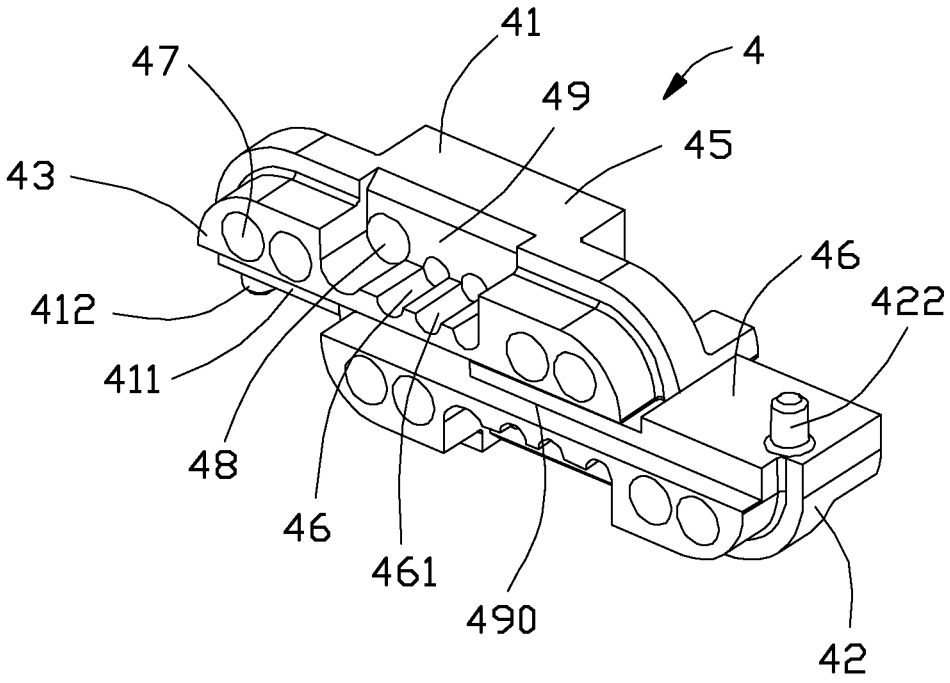
FIG. 9 is a view showing the spacer at a different arrangement.

Referring also to FIG. 9, the spacer 4 comprises an upper half 41 and a lower half 42 mounted to the upper half 41. Each spacer half has a front face 43, an opposite rear face 44, a top face 45, a bottom wall 46, and a plurality of through holes 47 and 48, each of the wires 31 and 32 of the cable 3 received in a corresponding through hole 47 or 48. The spacer 4 is further provided with a notch 49 at the junction of the top and front faces 45 and 43 or over the bottom wall 46. In this area of the notch 49, it can be seen that a wire positioning groove 461 is formed at the bottom wall 46 or is formed as a continuing part of the through hole 48. The spacer 4 is forwardly pressed against a rear side of the PCB 2. Posts 412, 422 and holes 413, 423 are correspondingly provided on the upper and lower halves 41 and 42 for proper engagement. The wires 31 and 32 of the cable 3 are divided into two rows by the upper and lower halves 41 and 42 for subsequent connection to the rear conductive pads 220 of the PCB 2. A respective step 490 is formed on each spacer half for engaging a rear edge of the PCB 2.

Moreover, in the embodiment shown, each spacer half is substantially a mirrored image relative to its imaginary center line along a front-to-rear direction in the aspect that two through holes 47 are provided on the left side, another two through holes 47 are provided on the right side, and four through holes 48 are provided in the middle. As can be understood, the middle holes 48 are for receiving the first type of wires 32 which are subject to comparatively less processing steps (e.g., one operation step) while the left and right-side holes 47 are for receiving the second type of wires 31 which are subject to comparatively more processing steps (e.g., three operation steps). If desired, the positions of first and second types of wires can be interchanged so that the second type of wires 31 are provided in the middle while the first type of wires 32 are provided on both sides. In either arrangement, the first and second types of wires are consecutively arranged.

Referring particularly to FIG. 3, the first shell 51 has a closed circumference that has a good seal performance, a good anti-EMI performance, etc. The closed circumference of the first shell 51 could be manufactured by drawing a metal piece, bending and forming a metal piece, die casting, etc. The first shell 51 comprises a first front end 511 telescoped with a rear end of the mating member 1, a first rear end 512 opposite to the first front end 511, and a first transition portion 53 between the first front and rear ends. The first front end 511 is larger than the first rear end 512. The first front end 511 defines a pair of latch holes 510 latched with the latch tabs 1520 of the third shell 15, when the first shell 51 is telescoped on an outer side of the third rear end 152 of the third shell 15. The first front end 511 of the first shell 51 is interference fit with the third rear end 152 of the third shell 15. The first front end 511 of first shell 51 and the third rear end 152 of the third shell 15 are further connected by laser welding in some spots or full circumference to have a good strength. The first rear end 512 is telescoped on an outer side of the spacer 4.

The second shell 52 has a closed circumference that has a good seal performance, a good anti-EMI performance, etc. The closed circumference of the second shell 52 could be manufactured by drawing a metal piece, bending and forming a metal piece, die casting, etc. The second shell 52 comprises a second front end 521 telescoped with the first rear end 512 of the first shell 51, a second rear end 522 telescoped and crimped with the cable 3, and a second transition portion 523 between the second front end 521 and the second rear end 522. The second front end 521 is larger than the second rear end 522. In assembling, firstly, the second shell 52 is telescoped on the cable 3. The second shell is moved forwardly and telescoped on the spacer 4, after the wires 31 and 32 are soldered on the rear conductive pads 220. Then, the second shell 52 are forwardly moved beyond the spacer 4 to latch with the first shell 51. The second front end 521 of second shell 52 and the first rear end 512 of the first shell 51 are further connected by spot laser welding to have a good strength.

The strain relief 6 is molded on the second shell 52 and the cable 3. The inner over-mold is molded on the first shell 51 and the third shell 15 to enhance the plug connector assembly 100. The outer over-mold 7 can be molded or mounted on the inner over-mold.

Figure 10:
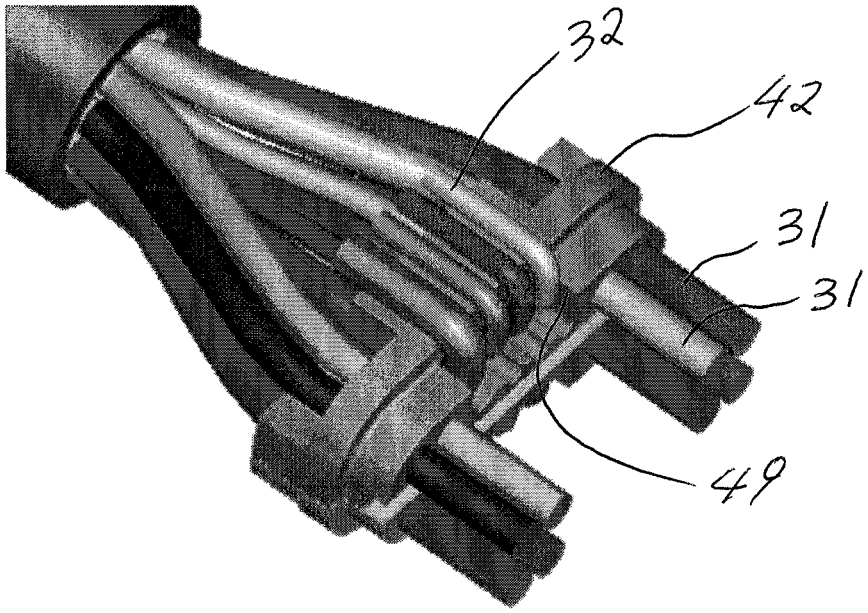
FIG. 10 is a view showing bent cable wires.

A method of preparing the cable wires 31 and 32 comprises the steps of: extending a first type and a second type of cable wires 32 and 31 through the wire spacer 4 having a notch 49; securing the first and second types of wires to the spacer; bending rearwardly the extended cable wires 32 of the first type in the spacer notch to be out of way, i.e., not in the operation path of the second type of cable wires 31, as shown in FIG. 10; operating the extended cable wires 31 of the second type; returning the extended cable wires of the first type to its original state before bending; and operating the extended cable wires of both the first type and the second type. Further, the step of operating the extended cable wires of the second type may comprise removing an outer jacket and removing a braiding thereof. Still further, the step of operating the extended cable wires of both the first type and the second type may comprise removing a respective dielectric thereof. Yet further, the step of extending may comprise arranging the first and second types of cable wires in an upper and a lower rows each including a plurality of first and second types of wires, passing the upper row of wires through an upper spacer half and the lower row of wires through a lower spacer half having a respective notch, and staggering the upper and lower spacer halves. Yet still further, the method may further comprise a step of soldering the operated wires of the first and second types to an internal printed circuit board.

What is claimed is:

1. A method of preparing cable wires of a cable connector, comprising the steps of:

extending a first type and a second type of cable wires through a wire spacer having a notch;

securing the first and second types of wires to the spacer;

bending the extended cable wires of the first type in the spacer notch;

operating the extended cable wires of the second type;

returning the extended cable wires of the first type; and operating the extended cable wires of both the first type and the second type.

2. The method as claimed in claim 1, wherein the step of operating the extended cable wires of the second type comprises removing an outer jacket and removing a braiding thereof.

3. The method as claimed in claim 1, wherein the step of operating the extended cable wires of both the first type and the second type comprises removing a respective dielectric thereof.

4. The method as claimed in claim 1, wherein the step of extending comprises arranging the first and second types of cable wires in an upper and a lower rows each including a plurality of first and second types of wires, passing the upper row of wires through an upper spacer half and the lower row of wires through a lower spacer half having a respective notch, and staggering the upper and lower spacer halves.

5. The method as claimed in claim 1, further comprising a step of soldering the operated wires of the first and second types to an internal printed circuit board.

6. A cable connector assembly comprising:

an insulative housing defining a front mating port forwardly communicating with an exterior along a front-to-back direction;

a plurality of contacts disposed in the housing with contacting sections exposed in the mating port and tail sections exposed around a rear side of the housing;

a cable located behind the housing in said front-to-back direction, and including a plurality of first wires and a plurality of second wires different from each other while being commonly enclosed within an outer jacket of the cable, wherein front sections of said first wires and said second wires are exposed outside of the jacket;

a wire organizer located between the housing and the jacket of the cable in said front-to-back direction and forming a plurality of first through holes and a plurality of second through holes essentially side by side arranged along a transverse direction perpendicular to said front-to-back direction; wherein both said first through holes and said second through holes are forwardly exposed to an exterior in the front-to-back direction; wherein front ends of the first through holes are located in front of said second through holes in the front-to-back direction; wherein said first through holes receive the corresponding first wires, respectively, and said second through holes receive the corresponding second wires, respectively.

7. The cable connector assembly as claimed in claim 6, wherein the first wires are diametrically larger than the second wires so that the first through holes are diametrically larger than the second through holes.

8. The cable connector assembly as claimed in claim 6, wherein the organizer further forms a plurality of grooves aligned with and in front of the second through holes, respectively, in said front-to-back direction, each of said grooves being exposed to an exterior in a vertical direction perpendicular to both said front-to-back direction and said transverse direction.

9. The cable connector assembly as claimed in claim 6, wherein the organizer includes two parts back to back stacked with each other, and each of said parts forms said first through holes and said second through holes therein to receive the corresponding first wires and said second wires.

* * * * *